US005678940A

United States Patent [19]

Moeck

[11] Patent Number: 5,678,940

[45] Date of Patent: Oct. 21, 1997

[54] REFILLING CONTAINER FOR A WRITING, MARKING, PAINTING OR DRAWING IMPLEMENT

[75] Inventor: Gerhard Moeck, Kirchehrenbach, Germany

[73] Assignee: Schwan-Stabilo Schwanhausser, Nuremberg, Germany

[21] Appl. No.: 454,114

[22] PCT Filed: Dec. 4, 1993

[86] PCT No.: PCT/DE93/01169

§ 371 Date: May 31, 1995

§ 102(e) Date: May 31, 1995

[87] PCT Pub. No.: WO94/13495

PCT Pub. Date: Jun. 23, 1994

[30] Foreign Application Priority Data

Dec. 14, 1992 [DE] Germany ..... 42 42 103.9
Oct. 12, 1993 [DE] Germany ..... 43 34 676.6

[51] Int. Cl.[6] ..... B43K 5/00; A46B 11/00

[52] U.S. Cl. ..... 401/203; 401/206; 401/119

[58] Field of Search ..... 401/203, 204, 401/205, 206, 207, 119, 118, 131

[56] References Cited

U.S. PATENT DOCUMENTS

| | | | |
|---|---|---|---|
| 2,708,904 | 5/1955 | Rhodes | 401/119 |
| 3,003,182 | 10/1961 | Rosenthal | 401/207 |
| 3,195,169 | 7/1965 | Chadbourn | 401/119 |
| 4,669,637 | 6/1987 | Fiocco | 401/206 X |
| 4,723,860 | 2/1988 | Giblin et al. | 401/206 X |

FOREIGN PATENT DOCUMENTS

| | | | |
|---|---|---|---|
| 971691 | 9/1964 | United Kingdom | 401/206 |
| 94/025293 | 11/1994 | WIPO | 401/119 |

*Primary Examiner*—Mickey Yu
*Assistant Examiner*—D. Neal Muir
*Attorney, Agent, or Firm*—Bachman & LaPointe, P.C.

[57] ABSTRACT

A refilling container (34) for a writing, marking, painting or drawing implement (10) which has a capillary reservoir (36) in a housing (16). The implement (10) can be inserted with its rearward housing end portion (12) into the container (34) for refilling purposes. The opening of the container (34) is provided with a sleeve (50) which is provided for fixing a capillary conveyor element (64) against which the reservoir (36) closely bears when the implement (10) is inserted into the sleeve (50) or the container (34).

17 Claims, 7 Drawing Sheets

REFILLING CONTAINER FOR A WRITING, MARKING, PAINTING OR DRAWING IMPLEMENT

BACKGROUND OF THE INVENTION

The invention concerns a refilling container for a writing, marking, painting or drawing implement.

A refilling container for refilling a writing, painting or drawing implement, a cosmetic applicator implement or the like, is known from the applicants' DE 40 27 751 A1. That known refilling container is provided for filling a corresponding implement from the front side thereof.

A refilling container for refilling a writing, painting or drawing implement which is also intended for refilling the corresponding implement from the front side thereof is known from the applicants' DE 40 39 614 A1.

As, in the case of those implements, the writing tip has a higher level of capillarity than the storage means or reservoir disposed in the housing of the implement, these implements which are to be filled through the writing tip suffer from the disadvantage that the reservoir can be refilled only very slowly and only with a relatively small amount of liquid. If the originally filled reservoir in such an implement has for example of the order of magnitude of 5 g of liquid, such an implement, when filled from the front, can only be limitedly filled again, that is to say, a relatively long period of time is required to fill such an implement again. Some hours can be needed in order to provide for adequate refilling, and that must be considered as a disadvantage.

A refillable writing or marking implement, in particular a felt-tip or fiber-tip pen, with a housing, a capillary reservoir for accommodating a writing or marking liquid and a capillary writing tip connected to said reservoir is known from the applicants' DE 30 14 761 C2. In that known implement, connected to the end of the reservoir element, which is remote from the writing tip, is a capillary filling wick which projects outwardly. That capillary filling wick is provided for refilling the implement from the rear end thereof.

DE 41 04 871 A1 discloses a refillable applicator implement, in particular a refillable writing, drawing, painting or marking implement, which for refilling with a liquid application agent has a closure body which can be at least partially removed from the end of the housing or shank portion. The end of the shank portion is closed by a sealing body which is non-detachably fixed in the shank portion or is formed integrally therewith. Associated with the sealing body is a closure body which, co-operating therewith, forms the closure. That known applicator implement can therefore be refilled from its rear end, in which respect, due to the structural configuration involved, overfilling of the implement is to be excluded only when a precisely defined amount of the liquid application agent is introduced into the implement. That also applies in regard to the refillable applicator implement which is known from DE 41 05 185A1 with a releasable closure body which, for filling the implement with liquid application agent, can be released from the shank portion by turning, and removed. In that applicator implement the end of the shank portion is closed by a sealing body which is non-detachably fixed in the shank portion or formed integrally therewith. Associated with the sealing body is a closure body which is releasable therefrom and which, co-operating therewith, forms the closure. The sealing body and/or the closure body each have at least one unlocking cam portion and at least one complementary pressure body.

A refilling container is known from DE-GM 92 06 513, in which the implement to be refilled can be inserted into the container or into the sleeve provided in the container, to such an extent that for example the reservoir of the implement bears against the capillary conveyor element. In that arrangement the insertion movement of the implement to be refilled is determined and delimited only by the contact between the reservoir and the refilling element so that if the implement is incorrectly inserted into the refilling container, the possibility of damage to the reservoir of the implement or damage to the conveyor element in the refilling container cannot be certainly excluded.

In addition there may be tolerances in regard to the axial extent of the reservoir of the implement, in relation to the rearward end portion of the housing, because in the manufacture of said implements it is scarcely possible to avoid the reservoirs being introduced into the associated housing to different distances in the individual implements. As a result the reservoirs of the individual implements may project with their rearward end face out of the housing to different distances when the protective cap has been removed from the housing. Furthermore it is possible for the capillary reservoirs of the implements themselves to involve certain dimensional, that is to say length tolerances. All this can mean that the contact between the rearward end face of the reservoir of an implement with the contact surface at the top side of the conveyor element disposed in the refilling container differs in relation to different implements to be refilled, or in the extreme situation is even interrupted, if the refilling container and the implement to be refilled are provided with an abutment and a counter-abutment for the purposes of definedly limiting the insertion movement of the implement into the refilling container.

A refilling container of the kind set forth in the opening part of this specification is known from FR-A-2 089 754. In that known refilling container the capillary conveyor element which is fixed in the sleeve bears closely with its underside against the bottom of the refilling container. The sleeve is at a small spacing from the bottom so that a small gap remains between the underside of the sleeve and the bottom of the refilling container, and liquid can pass through the gap from the refilling container to the capillary conveyor element. Here however, due to the abutment and the counter-abutment which definedly limit the insertion movement of an implement to be refilled, there is the problem that tolerances of the implement to be refilled or its capillary reservoir or dimensional tolerances of the capillary conveyor element in the refilling container are not compensated. That can at least adversely affect refilling of an implement. That also applies in a corresponding manner in regard to the refilling container as is known from U.S. Pat. No. 4,614,163.

DE-GM 92 07 098 discloses a device for refilling writing implements, which is provided with wicks of felt or plastic fibers for application of the writing or marking liquid such as ink and which is provided with a capillary writing liquid reservoir. That device is characterized by a separate liquid storage container with an adaptor at its upper end, which accommodates the tip of a writing implement, which is provided with a small capillary tube which dips into the storage container, as an intermediate reservoir.

SUMMARY OF THE INVENTION

The invention is based on the object of providing a refilling container of the kind set forth in the opening part of this specification, in which damage to the reservoir of the implement to be refilled and/or damage to the capillary conveyor element provided in the refilling container are reliably avoided, in which case suitable implements can be easily refilled without involving a great deal of time, even when the reservoirs thereof have dimensional or manufacturing tolerances.

In accordance with the invention that object is attained by the features of the present invention.

The configuration of the refilling container according to the invention affords the advantage that precisely defined contact between the rearward end face of the reservoir of an implement to be refilled and the contact surface at the upper end of the capillary conveyor element in the refilling container is guaranteed at any time. In that case the spring element is desirably disposesd on the side of the capillary conveyor element, which is remote from the contact surface for the reservoir of an implement to be refilled. When a suitable implement is being refilled, the spring element which co-operates with the conveyor element affords resilient contact at any time between the conveyor element, that is to say its contact surface at its upper end, and the reservoir to be refilled, that is to say its rearward end face, when a suitable implement to be refilled is inserted into the refilling container with the protective cap removed from its housing. That insertion movement is limited in an accurately defined manner by the above-mentioned abutment and counter-abutment provided on the housing of the implement to be refilled and on the refilling container. Dimensional tolerances in respect of the reservoirs of different implements to be refilled can be easily compensated in an advantageous manner by the provision of the spring element between the container and the capillary conveyor element. Those dimensional tolerances concern both possible tolerances in respect of length of different reservoirs and also production tolerances in respect of the dimensions with which the reservoirs of different implements may project from the housing thereof at the rearward end thereof. The spring element therefore advantageously ensures that the conveyor element is moved towards the reservoir of the implement to be refilled, by means of the spring element, so as to ensure at any time a reliably liquid-conducting communication between the reservoir of the corresponding implement to be refilled and the capillary conveyor element.

It has been found that insertion of the reservoir into the housing of an implement to be refilled frequently causes the fibers of the reservoir to be displaced in such a way that the rearward end face of the reservoir has a concave depression or indentation. In order to ensure that, even when the rearward end face is of such a configuration, even if it is unintentional, there is a reliable liquid-conducting communication between the reservoir, that is to say its rearward end face, and the capillary conveyor element, that is to say the contact surface at its upper end, it has been found advantageous if, in the container according to the invention, the capillary conveyor element is provided at its upper end with a raised contact surface. That may advantageously involve a contact surface which is of a frustoconical configuration. In that case the frustoconical contact surface is desirably of a somewhat smaller diameter than the sheathing of the reservoir so that the capillary conveyor element has its reduced frustoconical contact surface reliably contacting the fibers of the reservoir even if—as stated above—the fibers are axially displaced when the reservoir is inserted into the writing implement.

The spring element, by means of which the capillary conveyor element is resiliently yieldingly arranged in the container, may be a coil spring of plastic material or metal or a resilient element of another suitable configuration such as a tubular sleeve or the like. Preferably, the spring element is formed by an open-pore sponge body which therefore has a certain degree of capillarity and which, besides its resiliency for the capillary conveyor element, at the same time affords the advantage that it also sucks up the last residues of the liquid in the refilling container and passes same to the capillary conveyor element. For that purpose the capillarity of the sponge body is suitably matched to that of the conveyor element.

The spring element is desirably positioned by the sleeve and it bears against the bottom of the container. In that respect positioning of the spring element by the sleeve can be ensured in such a way that the spring element can change in volume or in external configuration, without impediment, in relation to the sleeve.

Simple and accurate mounting of said sleeve in the container is possible if the sleeve is provided with an abutment for defined axial fixing thereof at the opening of the container. That abutment can be a flange which extends around the sleeve on the outside thereof and which desirably bears sealingly and snugly against the annular end face of the bottle neck of the container, thus providing not only for accurately defined axial fixing of the sleeve in the container but at the same time also a liquid seal. For that purpose the end face of the bottle neck, which extends in an annular configuration around same, can be provided or formed with a sealing ridge. It is however also possible for the sleeve to be arranged so-to-speak upside down in the bottle neck and to be fixed with a ridge extending therearound at its lower end to a corresponding contact portion of the bottle neck.

Complete emptying of the container according to the invention is possible if the sleeve extends with its inner end only into the vicinity of the bottom of the container. That provides a fluid communication between the interior of the sleeve or the conveyor element arranged therein, and the interior of the container. Complete emptying of the container according to the invention in that way is also possible when the sleeve bears with its inner end against the bottom of the container, in which case the inner end is provided with at least one opening in order to produce a fluid communication between the interior of the sleeve and the conveyor element arranged therein, and the interior of the container. When the sleeve is provided with at least one opening, it has been found desirable if the/each opening is provided in such a way that there is a fluid communication which serves for venting purposes through the end portion of the opening which projects above the level of the surface of the liquid, between the interior of the sleeve and the interior of the container which is above the surface of the liquid. That provides for reliable conveyance of the liquid from the container by way of the conveyor element into the reservoir of the implement which is to be refilled from the rearward end, because a reduced pressure in the interior of the container is prevented. The conveyor element serves primarily for reliably refilling a writing implement to be refilled, but at the same time the conveyor element also serves as an outflow barrier which, when the refilling container is in an open condition, prevents liquid in the container from accidentally flowing out.

Accurately defined filling of an implement of the indicated kind is achieved if the conveyor element presents a capillarity which is slightly less than that of the reservoir of the implement to be filled. Such a configuration reliably prevents in a simple fashion undesired overfilling of a corresponding writing implement. At the same time this arrangement affords the advantages that the operation of filling a corresponding implement is effected from its rear and in a time of the order of magnitude of from 2 through 5 minutes, with the reservoir being filled with about 98% of the original filling amount of liquid.

The provision of the abutment on the implement, which definedly limits the insertion movement of the implement to be refilled, and the associated counter-abutment on the container, afford precisely defined conditions in regard to the insertion movement of an implement to be refilled into the refilling container, and those conditions prevent damage to the rearward end portion of the reservoir, as has already been mentioned hereinbefore. At the same time this provides that the reservoir comes to bear against the capillary conveyor element of the refilling container in an accurately defined manner, thereby also preventing damage to the conveyor element while in addition refilling liquid in the container is transported by the conveyor element to the capillary reservoir of the implement to be refilled.

In the condition for refilling of the implement, when it is inserted into the container, the abutment and the counter-abutment can seal off the system consisting of the refilling container and the implement, relative to the surrounding atmosphere. A hermetic sealing effect of that kind between the implement to be refilled or its housing and the refilling container permits optimum refilling of the implement, in a time-saving operation. In that respect, equalization of pressure within the closed system consisting of the refilling container and the implement to be refilled, which is inserted into same, can take place by way of the reservoir of the implement to be refilled.

BRIEF DESCRIPTION OF THE DRAWINGS

Further details, features and advantages will be apparent from the following description of embodiments, illustrated in the drawing, of the refilling container according to the invention in each case in conjunction with a writing, marking, painting or drawing implement to be refilled, of which a portion is shown. In the drawing.

DETAILED DESCRIPTION

Figure 1:
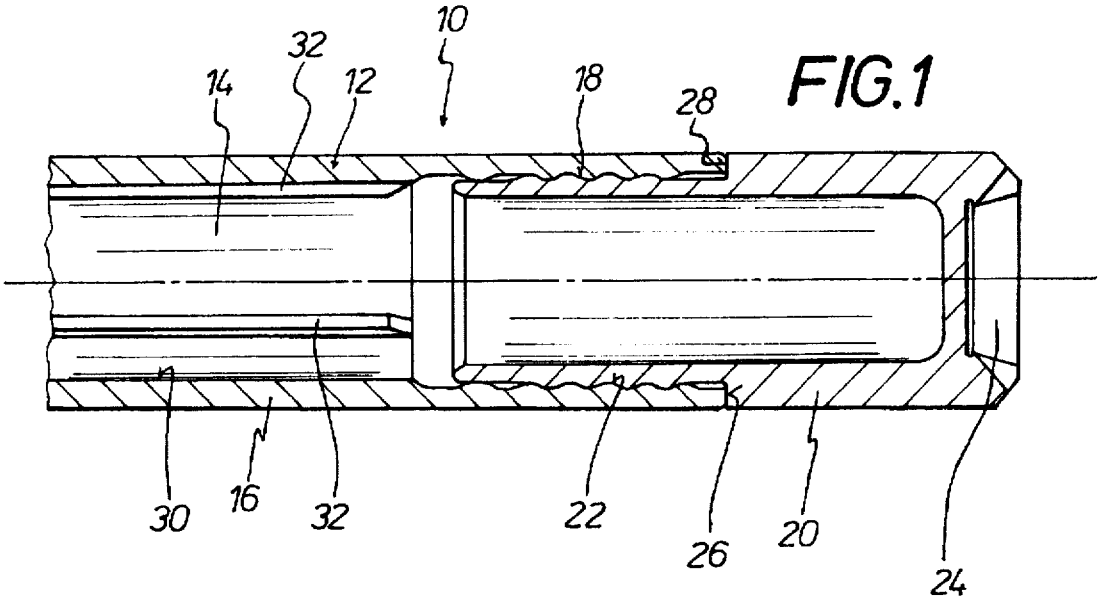
FIG. 1 is a view in longitudinal section of a rearward end portion of an implement, without showing the capillary reservoir of the implement.

FIG. 1 shows a refillable writing implement 10 or the rearward end portion 12 thereof, without showing the capillary reservoir which is disposed in the interior 14 of the writing implement 10. The writing implement 10 has a housing shank portion or housing 16 which at its rearward end portion 12 is provided with an internally screwthreaded portion 18. A protective cap 20 is provided with an externally screwthreaded portion 22 corresponding to the internal screwthread 18, so that the protective cap 20 can be fixed to the rearward end portion 12 of the housing 16 or if necessary can be unscrewed from the housing 16. For that purpose the protective cap 20 is provided for example with an opening 24 for the insertion of a suitable tool or aid such as a coin or the like.

The protective cap 20 is provided with a flange 26 which extends therearound and which definedly limits the screwing-in movement in relation to the housing 16, by said flange 26 coming to bear against the rearward end 28 of the housing 16. The rearward end 28 therefore forms an abutment for the protective cap 20.

On its inside wall 30 the housing 16 has longitudinal ribs 32 which serve for clamping fast the capillary reservoir (not shown) of the writing implement 10.

Figure 2:
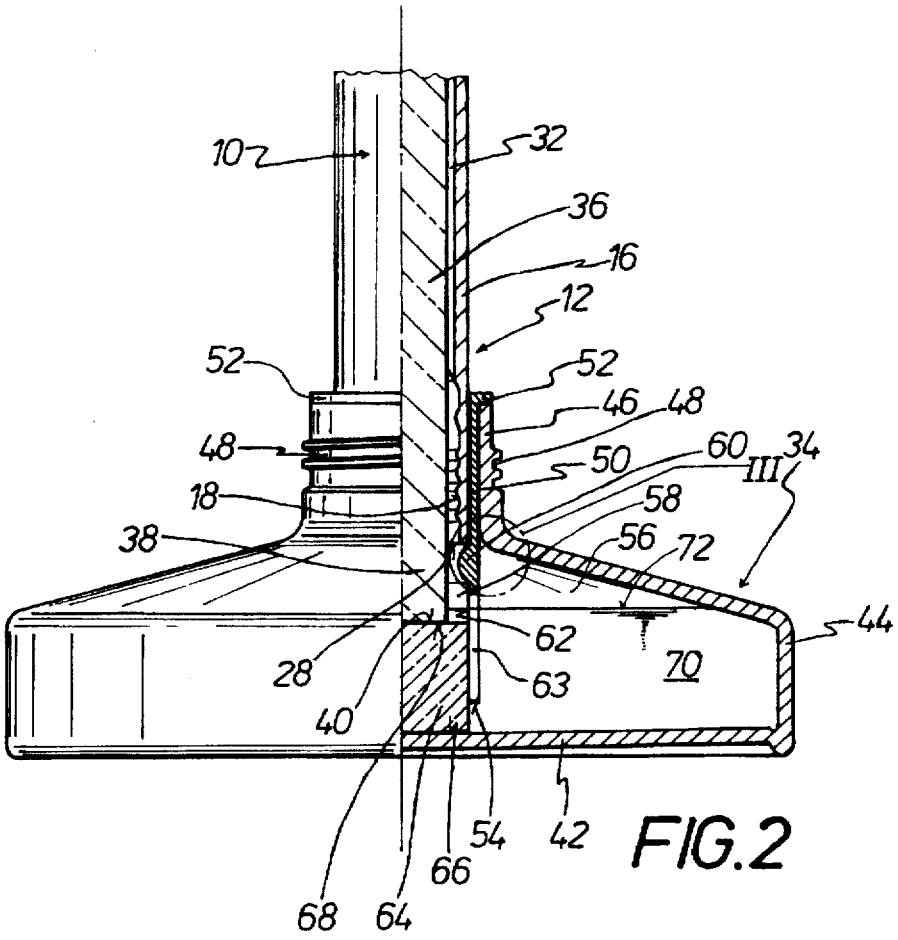
FIG. 2 is a view, half in section, of a refilling container and an implement, only part of which is shown, inserted into the refilling container for refilling thereof.

FIG. 2 shows a refilling container 34 and part of a writing implement 10 to be refilled, which for refilling purposes is inserted with its rearward end portion 12 into the refilling container 34. This Figure also shows part of the capillary reservoir 36 of the implement 10, which has its rearward end portion 38 projecting beyond the rearward end 28 of the housing 16 of the implement 10. The rearward end portion 38 of the capillary reservoir 36 of the implement 10 is defined by the rearward contact surface 40. The reservoir 36 is fixed in the housing 16 by the longitudinal ribs 32 in such a way that the contact surface 40 of the reservoir 36 projects by a defined distance beyond the rearward end 28 of the housing 16. Reference numeral 18 in FIG. 2 also identifies the internally screwthreaded portion in the rearward end portion 12 of the housing 16 of the implement 10.

The refilling container 34 has a bottom bottle portion 42, a side wall 44 which projects from the bottom and which extends therearound, and an opening which is remote from the bottom 42, with an upper neck portion 46. The bottle neck 46 has an externally screwthreaded portion 48 which is described hereinafter with reference to FIG. 5.

Figure 3:
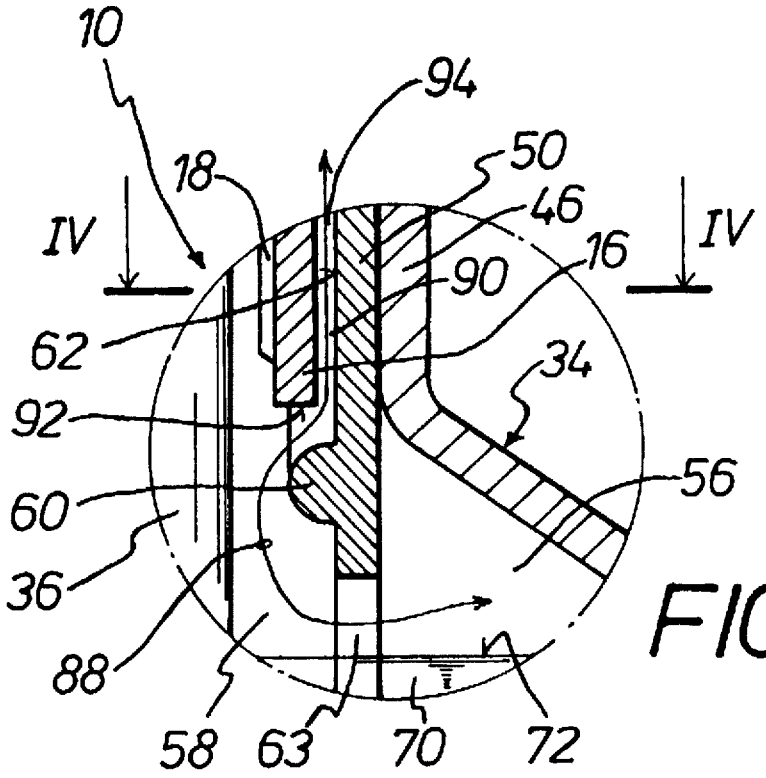
FIG. 3 is a view on an enlarged scale of the detail III in FIG. 2, to illustrate venting during the filling operation.

Disposed in the bottle neck 46 of the refilling container 34 is a sleeve 50 which is sealingly fixed in the bottle neck 46. At its end which projects out of the refilling container 34 the sleeve 50 is provided with an abutment 52 which may be for example a peripherally extending flange of an outside diameter which corresponds to the outside diameter of the bottle neck 46. The sleeve 50 is of axial dimensions such that it extends with its inner end 54 into the vicinity of the bottom 42 of the refilling container 34. In that way, a fluid communication is afforded between the interior 56 of the refilling container 34 and the interior 58 of the sleeve 50. The sleeve 50 has a counter-abutment 60 which projects from the inside wall 62 of the sleeve 50 into the internal space 58 thereof. The counter-abutment 60 can be in the form of a peripherally extending ridge. The counter-abutment 60 accurately definedly limits the insertion movement of the implement 10, by virtue of the rearward end 28 of the housing 16 of the implement 10 coming to bear against the counter-abutment 60 of the sleeve 50. The sleeve 50 is provided with at least one axially extending elongate opening 63. The opening is of such dimensions that, even in the condition of the refilling container 34 in which it is filled to the maximum, there is a fluid communication between the interior 58 of the sleeve 50 and the internal space 56 in the refilling container 34, above the liquid level 72. This can be particularly clearly seen from FIG. 3 in which the fluid communication between the interior 56 of the refilling container 34 above the liquid level 72 and the interior 58 of the sleeve 50 is made clear by a curved arrow 88. It is also clear from FIG. 3 that ribs 90 project away from the inside wall 62 of the sleeve above the ridge-like counter-abutment 60, the ribs 90 being formed with a step 92. The step 92 of each rib 90 is at a defined spacing from the counter-abutment 60 which extends in a peripheral ridge-like configuration so that a passage is provided between the writing implement 10 to be refilled, which is inserted into the sleeve 50, or the housing 16 thereof, and the sleeve 50; the passage guarantees a fluid communication as indicated by the arrow 88 in FIG. 3, between the interior 56 and the area surrounding the refilling container 34. That fluid communication prevents a reduced pressure, which would impede the refilling operation, from being built up in the interior 56 of the refilling container 34 during the step of refilling a writing implement 10.

Figure 4:
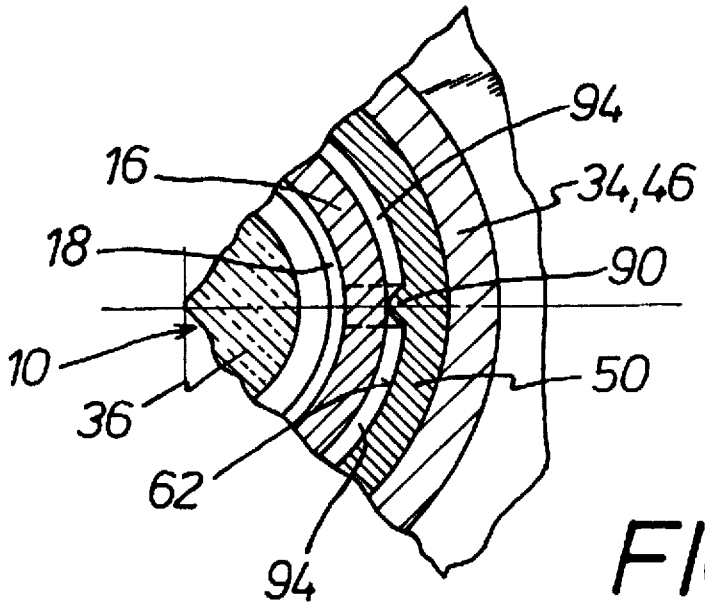
FIG. 4 is a view in section taken along section line IV—IV in FIG. 3.

FIG. 4 shows a portion of the writing implement 10 or the housing 16 of the writing implement 10 and a portion of the sleeve 50 which is arranged in the container 34 of which a portion is shown. Ribs 90 project inwardly from the inside well 62 of the sleeve 50. FIG. 4 shows only one rib 90. The ribs 90 are uniformly distributed at the periphery of the sleeve 50. They serve to center the housing 16 of the writing implement during the refilling operation and in particular to form a venting passage 94 between the housing 16 and the sleeve 50.

Fixed in the interior 58 of the sleeve 50 is a capillary conveyor element 64 which with its base surface 66 at its lower end can touch the bottom 42 of the refilling container 34 and which, on the side remote from the base surface 66, has a contact surface 68 for the rearward end face 40 of the capillary reservoir 36. The capillary conveyor element 64 can be a suitable sponge material. It is advantageous if the conveyor element 64 presents a capillarity which is less than that of the reservoir 36 of the implement 10 to be refilled, because overfilling of the implement 10 is then prevented.

Disposed in the interior 56 of the refilling container 34 is a refilling liquid 70, the level 72 of which, in the original unused condition of the refilling container 34, can be above the capillary conveyor element 64 or the contact surface 68 thereof, as can be seen from FIG. 2.

Figure 5:
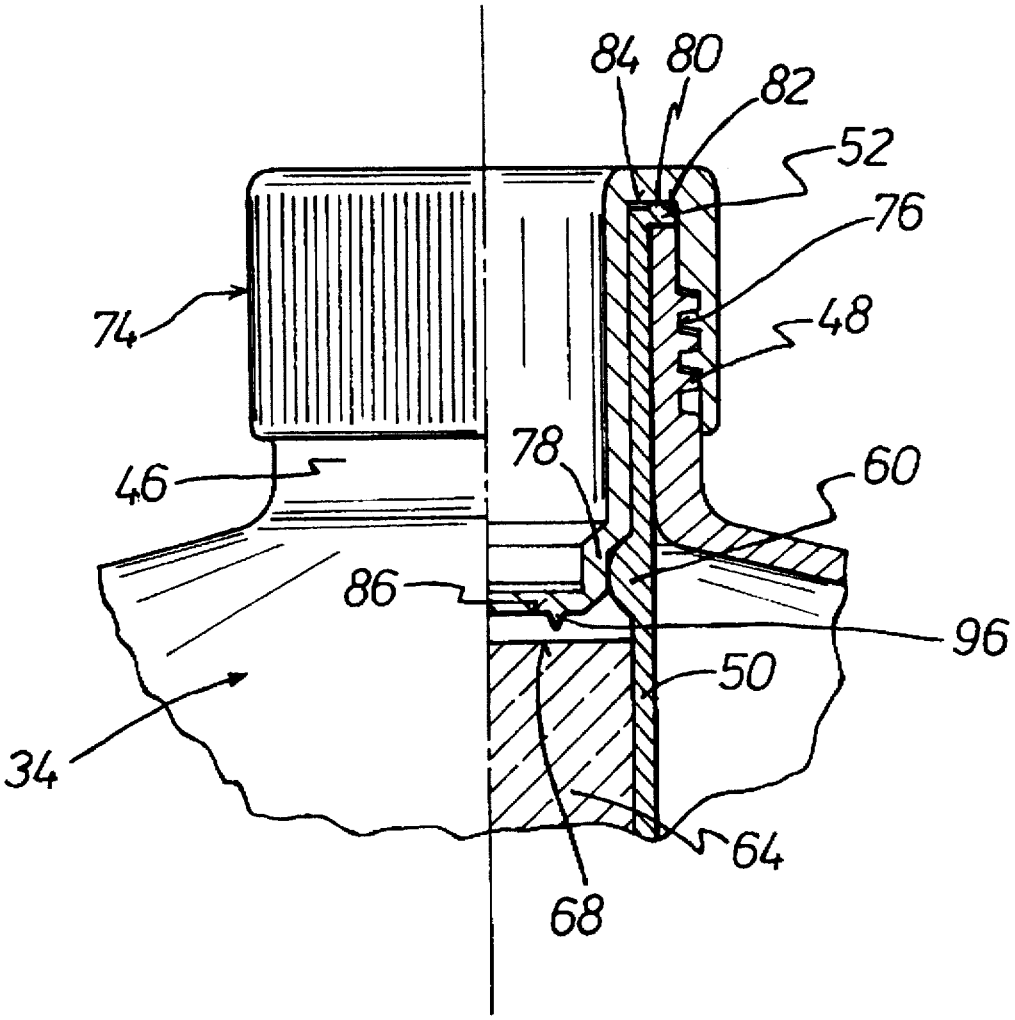
FIG. 5 is a view, half in section, of a portion of the refilling container, in the closed condition of non-use.

FIG. 5 shows a portion of the refilling container 34 or the bottle neck 46 thereof with the externally screwthreaded portion 48. The externally screwthreaded portion 48 serves for screwing on a closure cap 74 for the refilling container 34, the cap for that purpose having an internally screwthreaded portion 76 which is suited to the externally screwthreaded portion 48. The closure cap 74 is provided for sealingly closing the container 34 and for that purpose has a sealing portion 78 which, in the closed condition of the refilling container 34, bears sealingly against the counter-abutment 60 of the sleeve 50. An additional sealing effect is afforded by a peripherally extending ridge 80 which projects upwardly from the outward end face 82 of the sleeve 50 or the abutment 52 of the sleeve 50 and which bears sealingly against a corresponding annular sealing surface 84 of the closure cap 74 when the closure cap 74 is screwed on to the refilling container 34. In this rest position or position of non-use of the refilling container 34 the closure cap 74 bears with a contact portion 86 against the contact surface 68 of the capillary conveyor element 64 so that the conveyor element 64 is fixed in an accurately defined manner between the contact portion 86 of the closure cap 74 and the bottom 42 of the refilling container 34 (see FIG. 2). The capillary conveyor element 64 is fixed in the sleeve 50 in such a way that the contact surface 68 of the conveyor element 64 is at a defined spacing from the inside end face 86 of the closure cap 74. At least one raised portion 96 projects downwardly from the inside end face 86 of the closure cap 64. The at least one raised portion 96 serves for cutting up or destroying liquid bubbles which are possibly present on the contact surface 68 of the capillary conveyor element 64.

Figure 6:
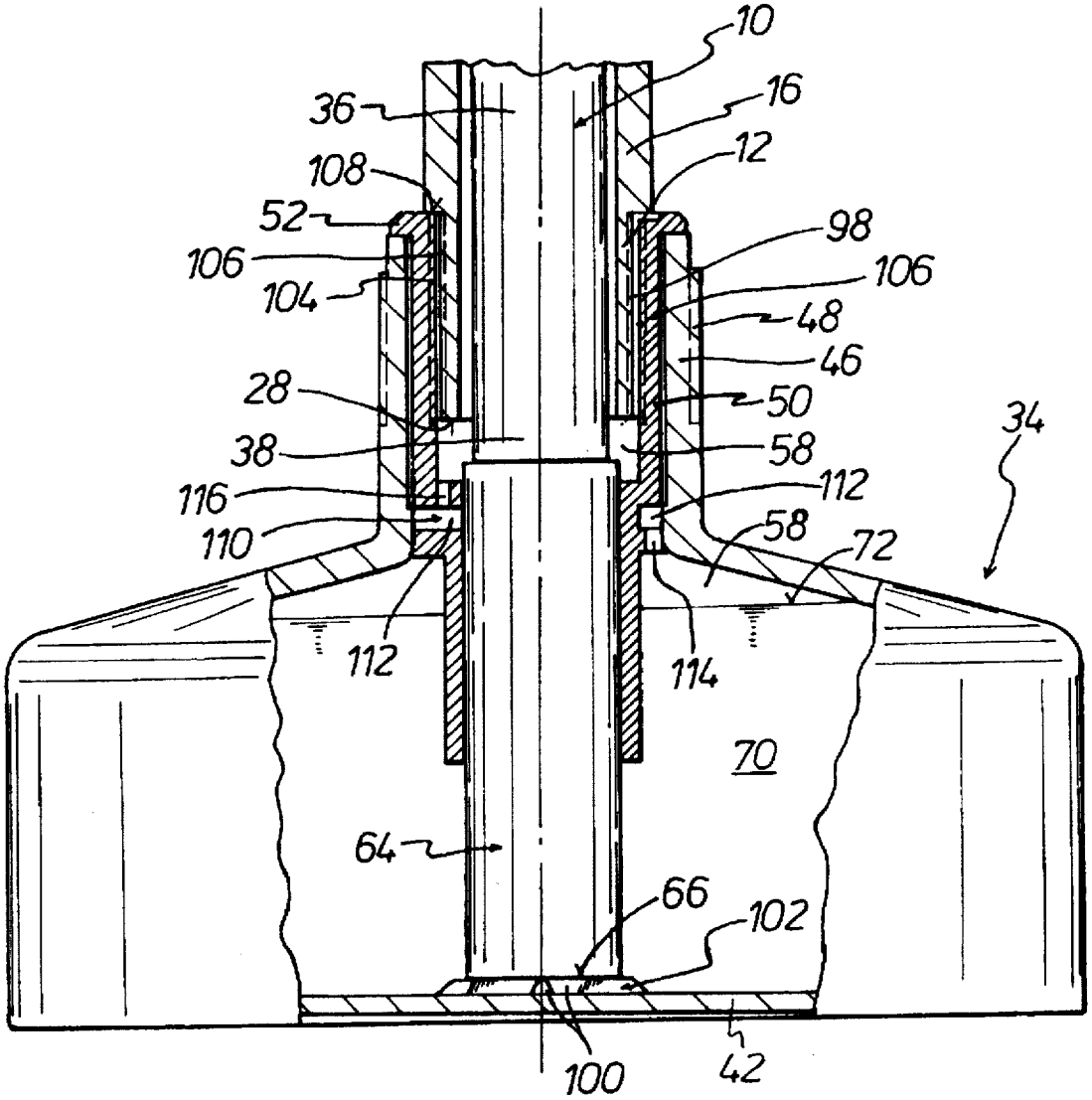
FIG. 6 is a view similar to FIG. 2 of a refilling container with a writing implement of which part is shown, in the refilling position.

FIG. 6 is a longitudinally sectioned view of an embodiment of the refilling container 34, with an implement 10 to be refilled of which a part is shown and the rearward end portion 12 of which is provided with an external screwthread 98. The external screwthreaded portion 98 serves in the normal condition of the writing implement 10 for screwing on a rear closure cap (not shown). In this embodiment the capillary reservoir 36 projects with a rearward end portion 38 beyond the rearward end 28 of the housing 16 of the writing implement 10, as in the case of the embodiment shown in FIG. 2.

In the embodiment shown in FIG. 6 the refilling container 34 also has a bottle neck 46 which is provided with an externally screwthreaded portion 48. Fixed in the bottle neck 46 of the refilling container 34 is a sleeve 50 which serves for definedly holding the capillary conveyor element 64 which is provided in the refilling container 34. The conveyor element 64 has its base surface 66 resting on a rib structure 100 which projects upwardly from the bottom 42 of the refilling container 34. The said rib structure 100 provides a defined gap 102 between the capillary conveyor element 64 and the bottom 42 of the refilling container 34 so as reliably to guarantee the fluid communication into the capillary conveyor element 64.

The sleeve 50 is provided with an internally screwthreaded portion 104 which is matched to the externally screwthreaded portion 98 at the rearward end portion 12 of the housing 16 of the writing implement 10. The externally screwthreaded portion 98 and the internally screwthreaded portion 104 which is adapted thereto are provided with longitudinal channels 106 which, in the refilling condition, that is to say when the housing 16 bears with its abutment 108 against the abutment 52 of the sleeve 50, provide a fluid communication between the atmosphere around the refilling container 34 and the interior 58 of the sleeve 50. That fluid communication is extended from there through a passage 110 which is provided in the sleeve 50 into the interior 58 of the refilling container 34, above the liquid level 72. The passage 110 in the sleeve 50 has a peripherally extending opening 112 into which open an opening 114 and an opening 116 which are provided on axially oppositely disposed sides of the peripherally extending opening 112.

Figure 7:
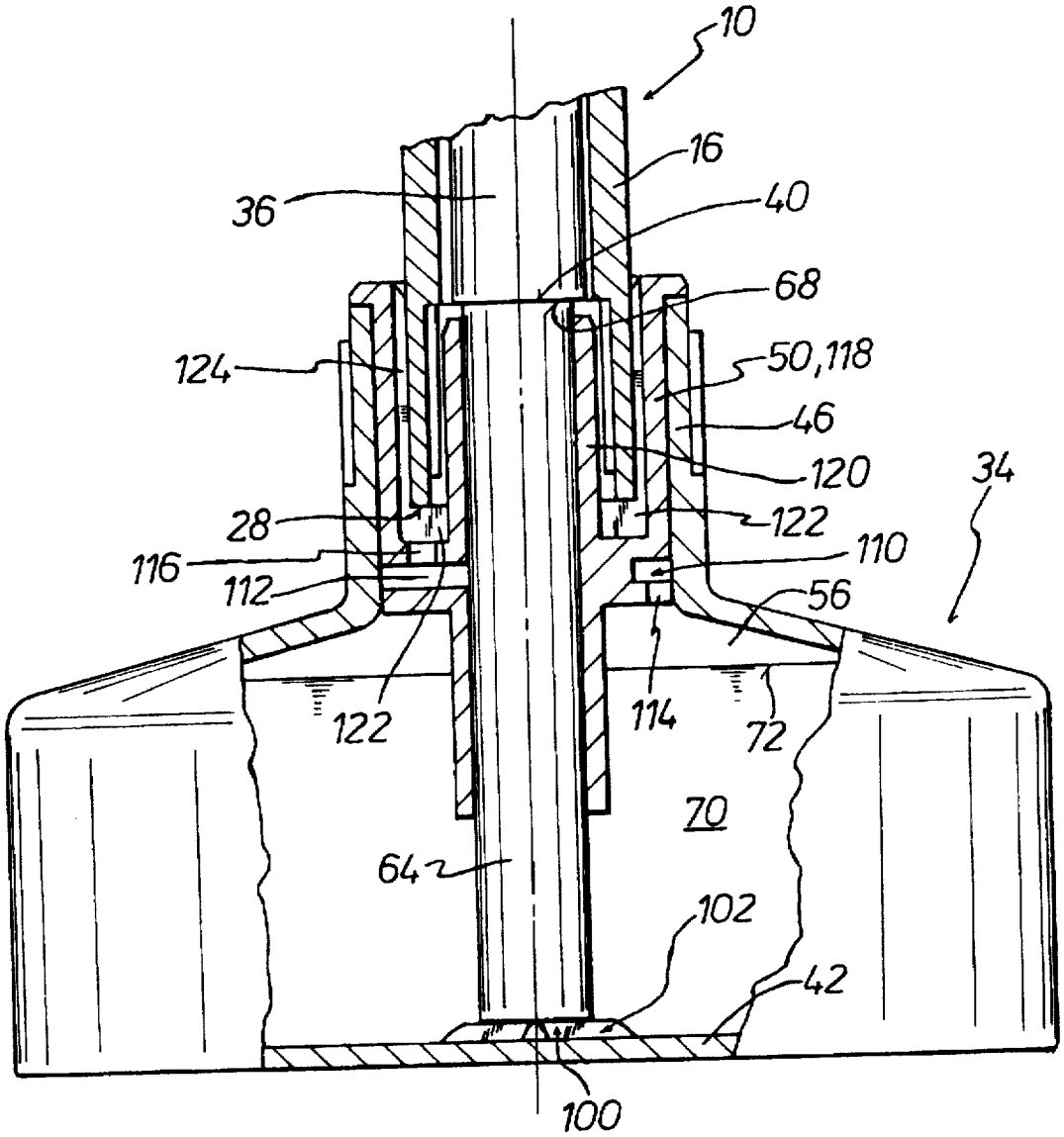
FIG. 7 is a partly cut-away view of another embodiment of the refilling container with a writing implement to be refilled, of which a part is shown.
Figure 8:
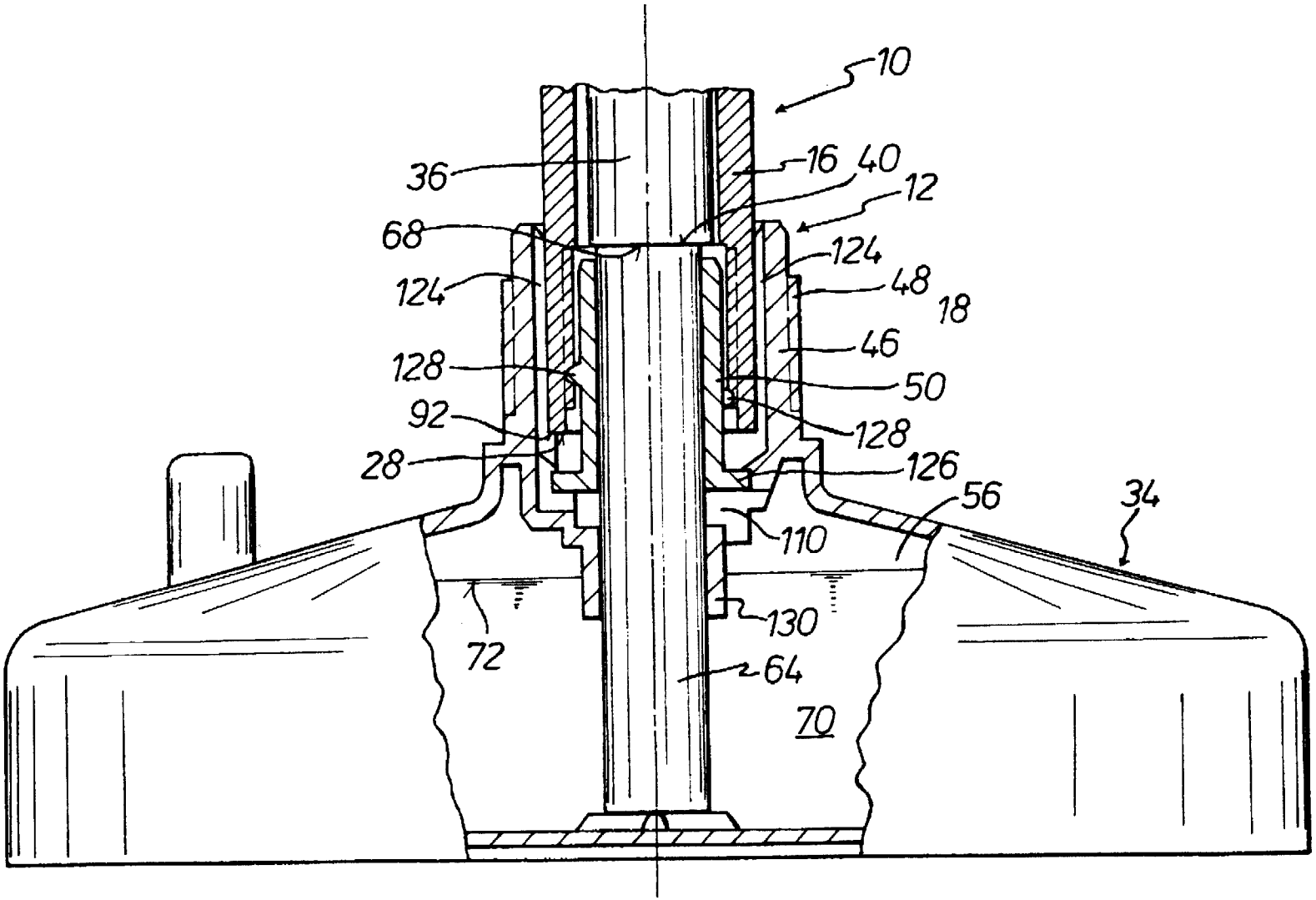
FIG. 8 is a partly cut-away view of a further embodiment of the refilling container with an implement to be refilled, of which part is shown.

While FIGS. 2 and 6 show writing implements in which the reservoir 36 projects from the housing 16 at the rear end, FIGS. 7 and 8 show portions of writing implements 10 in which the capillary reservoir 36 is set back into the interior of the writing implement 10 relative to the rearward end 28 of the housing 16 of the writing implement 10.

In this connection, FIG. 7 shows a refilling container 34 with a bottle neck 46 in which there is fixed a sleeve 50 which is not only provided with a fixing portion 118 which hears snugly against the bottle neck 46, but in addition also with a fixing portion 120 which is concentric with the fixing portion 118 and which serves for securing the capillary conveyor element 64 disposed in the refilling container 34.

Radial ribs 122 extend between the outer and the inner fixing portions 118 and 120, and serve for definedly limiting the insertion movement of the writing implement 10 to be refilled, into the refilling container 34. In this connection, in the refilling position the capillary reservoir 36 bears with its rearward end face 40 snugly against the contact surface 68 of the capillary conveyor element 64 so that the reservoir 60 can be filled with the liquid 70 in the refilling container 34, by means of the conveyor element 64.

The embodiment of the refilling container 34 shown in FIG. 7 also provides that the bottom 42 has a rib structure 100 in order to establish a defined gap 102 between the capillary conveyor element 64 and the bottom 42 of the refilling container 34. The capillary conveyor element 64 is filled through the defined gap 102 with liquid 70 which is then sucked into the reservoir 36 of the writing implement 10 to be refilled, through the capillary conveyor element 64. In order to ensure that, during this sucking-in operation, the interior 56 of the refilling container 34 above the liquid level 72 is not subjected to a reduced pressure which would adversely affect delivery of liquid or in the extreme situation interrupt same, this embodiment also provides that the sleeve 50 has a passage 110 which again comprises a peripherally extending opening 112 and two openings 114 and 116. The sleeve 50 is provided at the inside of its flange-like outer fixing portion 118 with ribs 124 which serve for centering the housing 16 of the writing implement 10 to be refilled and at the same time provide the above-mentioned fluid communication between the interior 56 of the refilling container 34 and the atmosphere surrounding same, for venting purposes.

FIG. 8 is a partly out-away view of an embodiment of the refilling container 34 into which a writing implement 10, of which a portion is shown, is inserted for refilling purposes, with its rearward end portion 12. The refilling container 34 has a bottle neck 46 having an externally screwthreaded portion 48. A sleeve 50 is fixed in an upside-down position in the bottle neck 46 of the refilling container 34 and is disposed concentrically with respect to the bottle neck 46. For the purposes of fixing it in the bottle neck 46, the sleeve 50 has a peripherally extending fixing flange 126. On its outside, the sleeve 50 has a spiral rib 128 which projects therefrom and which engages into the internally screwthreaded portion 18 at the rearward end portion 12 of the housing 16.

The bottle neck 46 is provided on its inside with longitudinal ribs 124 which serve for centering the housing 16. The ribs 124 are of a configuration having a step 92, similarly to the construction shown in FIG. 3, whereby the insertion movement of the writing implement 10 to be refilled into the refilling container 34 is limited in an accurately defined manner so that the reservoir 36 of the writing implement 10 bears with its end face 40 accurately against the contact surface 68 of the capillary conveyor element 64. In this embodiment of the refilling container 34 the conveyor element 64 is suitably fixed by a flange 130 of the refilling container 34 and by the sleeve 50 which is fixed in the bottle neck 46. In this embodiment also the refilling container 34 has a venting passage 110 through which a fluid communication is formed between the internal space 56 above the level 72 of the liquid 70 in the container 34, and the atmosphere surrounding the refilling container 34. By virtue of the bottle neck 46 having the ribs 124, that fluid communication extends past the ribs 124 along same between the bottle neck 46 and the writing implement 10 to be refilled, which is fitted thereinto.

In the case of the above-described refilling container, the internal space is in fluid communication with the ambient atmosphere. Tests have shown however that such a fluid communication is not absolutely necessary. More specifically it is also possible for the reservoir in the writing implement to have air flowing therearound. Accordingly the container with the writing implement to be refilled, which is fitted thereto, represents a self-contained system in which a suitable pressure equalization effect can occur. In that situation, in-flowing liquid displaces the corresponding volume of air so that that amount of air passes into the interior of the container. Contact with the outside environment is therefore not absolutely necessary. What is necessary however is pressure equalization as between the interior of the container and the interior of the sleeve, by way of the at least one gap 63 provided in the sleeve, because otherwise there is the danger of liquid 70 flowing out, or some other malfunction occurring.

Figure 9:
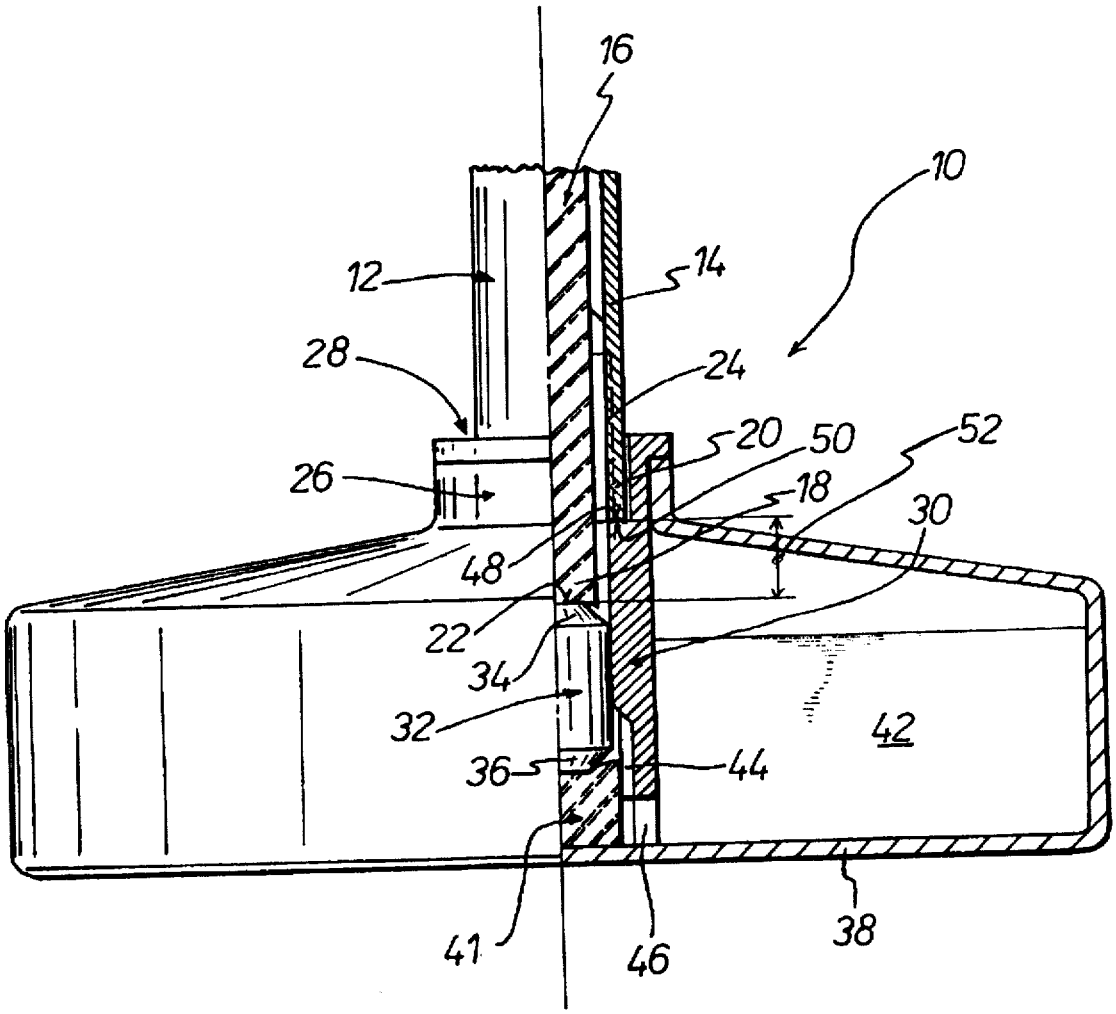
FIG. 9 is a view similar to FIG. 2 of a further embodiment of the refilling container with an implement to be refilled, of which part is shown.

FIG. 9 shows a refilling container 10 for an implement 12 of which a portion is shown, the refilling container and the implement in the refilling condition forming a closed system, as has been mentioned above. The implement 12 has a housing 14 and a capillary reservoir 16 which is fixed in the housing 14 and which has its rearward end portion 18 projecting out of the rearward end portion 20 of the housing 14. The reservoir 16 has a rearward end face 22 which, due to the manufacturing procedure involved, can be of a concave or indented configuration.

The rearward end portion 20 of the busing 14 of the implement 12 can have a screwthreaded portion 24 which serves for screwing to a protective cap (not shown) for protecting the reservoir 16.

The refilling container 10 is provided for example with a bottle neck 26 defining a container opening 28 in which a sleeve 30 is fixed. The sleeve 30 serves for fixing a capillary conveyor element 32 which at its upper end can have a raised contact surface 34 in order to guarantee reliable contact being made between the conveyor element 32 and the reservoir 16 of an implement 12 to be refilled, even when the reservoir 16 does not have a flat end face 22 but—as shown in the drawing—has an indented or concave end face 22.

So that there is no need to maintain a specific orientation of the capillary conveyor element 32 when the capillary conveyor element 32 is inserted into the sleeve 30 of the refilling container 10, it is advantageous if the contact surface 34 at the upper end and the base surface 36 at the lower end of the capillary conveyor element 32 are of the same shape.

Provided between the capillary conveyor element 32 and the bottom 38 of the refilling container 10 is a spring element 41 which is preferably formed from an open-pore, elastically yielding sponge body which provides for capillary conveyance of the liquid 42 in the refilling container 10. The spring element 41 can be precisely correctly positioned with respect to the capillary conveyor element 32 by ribs 44 on the inside of the sleeve 30.

In order to produce a fluid communication between the interior of the refilling container 10, that is to say between the liquid 42 therein, and the capillary conveyor element 32, either the sleeve 32 is at a given spacing from the bottom 38, or the sleeve 30 is provided with at least one passage 46.

The implement 12 or the housing 14 thereof has an abutment 48 which is formed for example by the rear annular end face of the housing 14. The sleeve 30 is provided with a counter-abutment 50, against which the implement 12 bears with its abutment 48 when the implement 12 to be refilled is inserted into the refilling container 10.

Dimensional tolerances in respect of the axial dimension as between the abutment 48 of the housing 14 and the rearward end face 22 of the reservoir 16 of the implement 12, which in the Figure is identified by reference numeral 52, are compensated by means of the spring element 41 in such a way that the capillary conveyor element 32 has its contact surface 34 at its upper end always reliably pressing against the rearward end face 22 of a corresponding implement 12 to be refilled when the implement is inserted for refilling purposes into the refilling container 10 until it bears with its abutment 48 against the counter-abutment 50.

It will be appreciated that it is also possible for the abutment 48 and counter-abutment 50 or the implement 12 and the sleeve 30 to be of any other desired configuration. The same applies in regard to the configuration of the conveyor element 32 or its contact surface 34 and its base surface 36.

The refilling container is intended in particular for refilling a writing implement from the rear end by way of its reservoir. It is however also possible for a corresponding writing implement to be inserted into the refilling container, with its tip leading, for refilling that writing implement.

I claim:

1. In a system for refilling a marking instrument with liquid, the combination comprising:

a marking instrument having a housing defining an interior space, a capillary receiver received in said interior space, a cap means removably secured to an end of said housing for exposing said capillary receiver when removed;

a refilling container having a bottle portion having a bottom and an upper neck portion, said bottom bottle portion defining a liquid receiver, a capillary conveyor element within said liquid receiver, said upper neck portion defining an opening, hollow sleeve means located within said opening and extending into said liquid reservoir, said hollow sleeve means having (1) first abutment means for locating said hollow sleeve within said opening at a desired location with respect to said liquid reservoir and (2) second abutment means for abutting the housing when said marking instrument is positioned in said bottom sleeve for refilling with liquid wherein said capillary reservoir contacts said capillary conveyor element.

2. A system according to claim 1 wherein said capillary reservoir and said capillary conveyor element contact each other in a resiliently yielding manner.

3. A system according to claim 2 wherein a spring element is provided between said capillary conveyor element and said bottom of said bottle portion.

4. A system according to claim 1 wherein said capillary conveyor element is formed at its upper end with a raised contact surface.

5. A system according to claim 4 wherein said capillary conveyor element is formed with a frustoconical contact surface.

6. A system according to claim 3 wherein said spring element is formed by an open-pore sponge body.

7. A system according to claim 3 wherein said spring element is positioned by said hollow sleeve and bears against said bottom.

8. A system according to claim 1 wherein said first abutment means bears on the opening.

9. A system according to claim 1 wherein said hollow sleeve extends proximate to said bottom.

10. A system according to claim 1 wherein said hollow sleeve has an inner end which bears against said bottom, said inner end being provided with at least one opening for fluid communication between the hollow sleeve and the conveyor element, and the liquid reservoir.

11. A system according to claim 1 wherein said second abutment means abuts said end of said housing.

12. A refilling container containing a liquid comprising:

a refilling container having a bottle portion having a bottom and an upper neck portion, said bottom bottle portion defining a liquid receiver, a capillary conveyor element within said liquid receiver, said upper neck portion defining an opening, hollow sleeve means located within said opening and extending into said liquid reservoir, said hollow sleeve means having (1) first abutment means for locating said hollow sleeve within said opening at a desired location with respect to said liquid reservoir and (2) second abutment means for abutting a housing of a marking instrument when said marking instrument is positioned in said bottom sleeve for refilling with liquid wherein said capillary reservoir contacts said capillary conveyor element.

13. A container according to claim 12 wherein a spring element is provided between said capillary conveyor element and said bottom of said bottle portion.

14. A container according to claim 13 wherein said capillary conveyor element is formed at its upper end with a raised contact surface.

15. A container according to claim 14 wherein said capillary conveyor element is formed with a frustoconical contact surface.

16. A container according to claim 13 wherein said spring element is formed by an open-pore sponge body.

17. A container according to claim 12 wherein said hollow sleeve has an inner end which bears against said bottom, said inner end being provided with at least one opening for fluid communication between the hollow sleeve and the conveyor element, and the liquid reservoir.

* * * * *